US008607801B1

(12) United States Patent
Mardirosoglu et al.

(10) Patent No.: US 8,607,801 B1
(45) Date of Patent: Dec. 17, 2013

(54) TOBACCO CHAMBER TOOL

(71) Applicants: Jacques Mardirosoglu, Ft. Lauderdale, FL (US); Edwige M. Kruglick, Ft. Lauderdale, FL (US)

(72) Inventors: Jacques Mardirosoglu, Ft. Lauderdale, FL (US); Edwige M. Kruglick, Ft. Lauderdale, FL (US)

( * ) Notice: Subject to any disclaimer, the term of this patent is extended or adjusted under 35 U.S.C. 154(b) by 0 days.

(21) Appl. No.: 13/721,657

(22) Filed: Dec. 20, 2012

(51) Int. Cl.
*A24C 5/00* (2006.01)

(52) U.S. Cl.
USPC ..... 131/70; 131/72; 134/6; 134/22.1

(58) Field of Classification Search
None
See application file for complete search history.

(56) References Cited

U.S. PATENT DOCUMENTS

| | | | |
|---|---|---|---|
| 705,591 | A | 7/1902 | Ludington |
| 1,967,610 | A | 7/1934 | Edwards |
| 2,022,461 | A | 11/1935 | Edwards |
| 2,997,828 | A | 8/1961 | Ahlbor |
| 6,095,151 | A | 8/2000 | Arthur |
| 6,206,006 | B1 | 3/2001 | Schutze et al. |
| 7,677,251 | B2 | 3/2010 | Barnes et al. |

*Primary Examiner* — Richard Crispino
*Assistant Examiner* — Phu Nguyen
(74) *Attorney, Agent, or Firm* — Richard L. Miller

(57) ABSTRACT

A tool that includes a handle and a head extending from the handle. A stationary shoe portion of the head levels tobacco as the tool pulls the tobacco down a chute of a cigarette-packing device and into a chamber of the cigarette-packing device. A pair of movable arm portions of the head eliminate dust of the tobacco from being pulled into the chamber of the cigarette-packing device by skipping over the dust of the tobacco being pulled down the chute of the cigarette-packing device, and packs the ends of the tobacco in the chamber of the cigarette-packing device more densely so as to form end plugs that prevent the tobacco from leaving a paper tube to thereby prevent collapsing of a finished cigarette.

26 Claims, 8 Drawing Sheets

METHOD FOR OPERATING THE TOOL 10
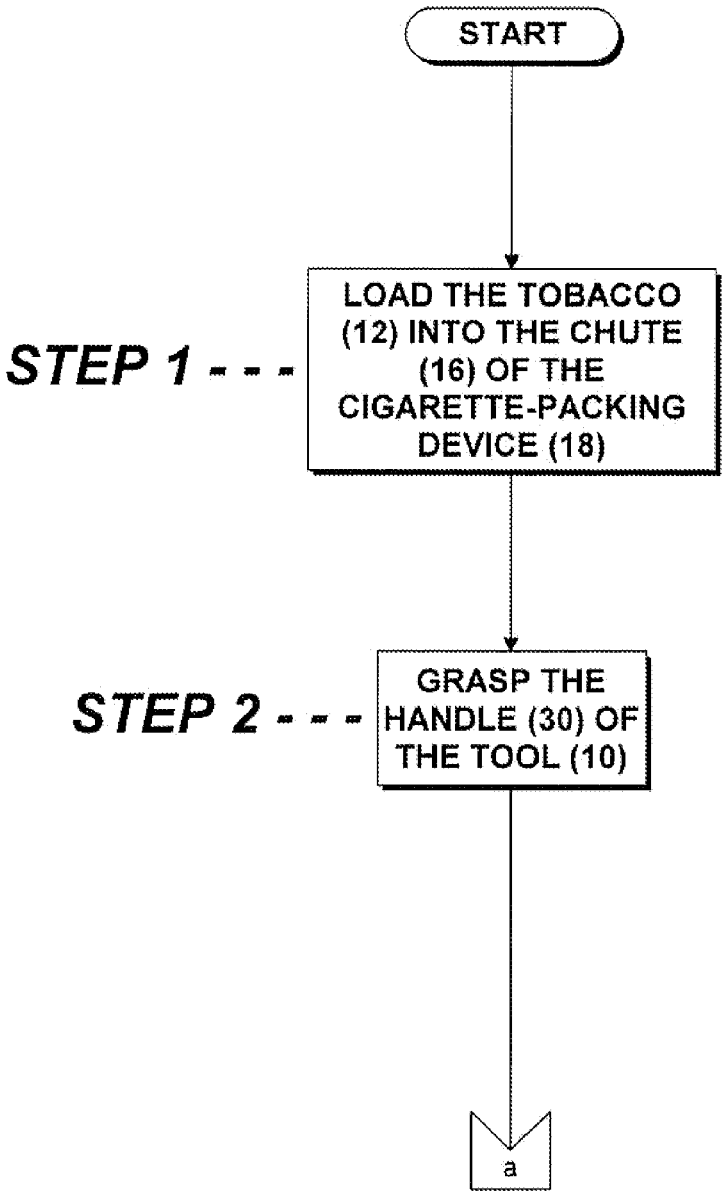
FIG. 8-A

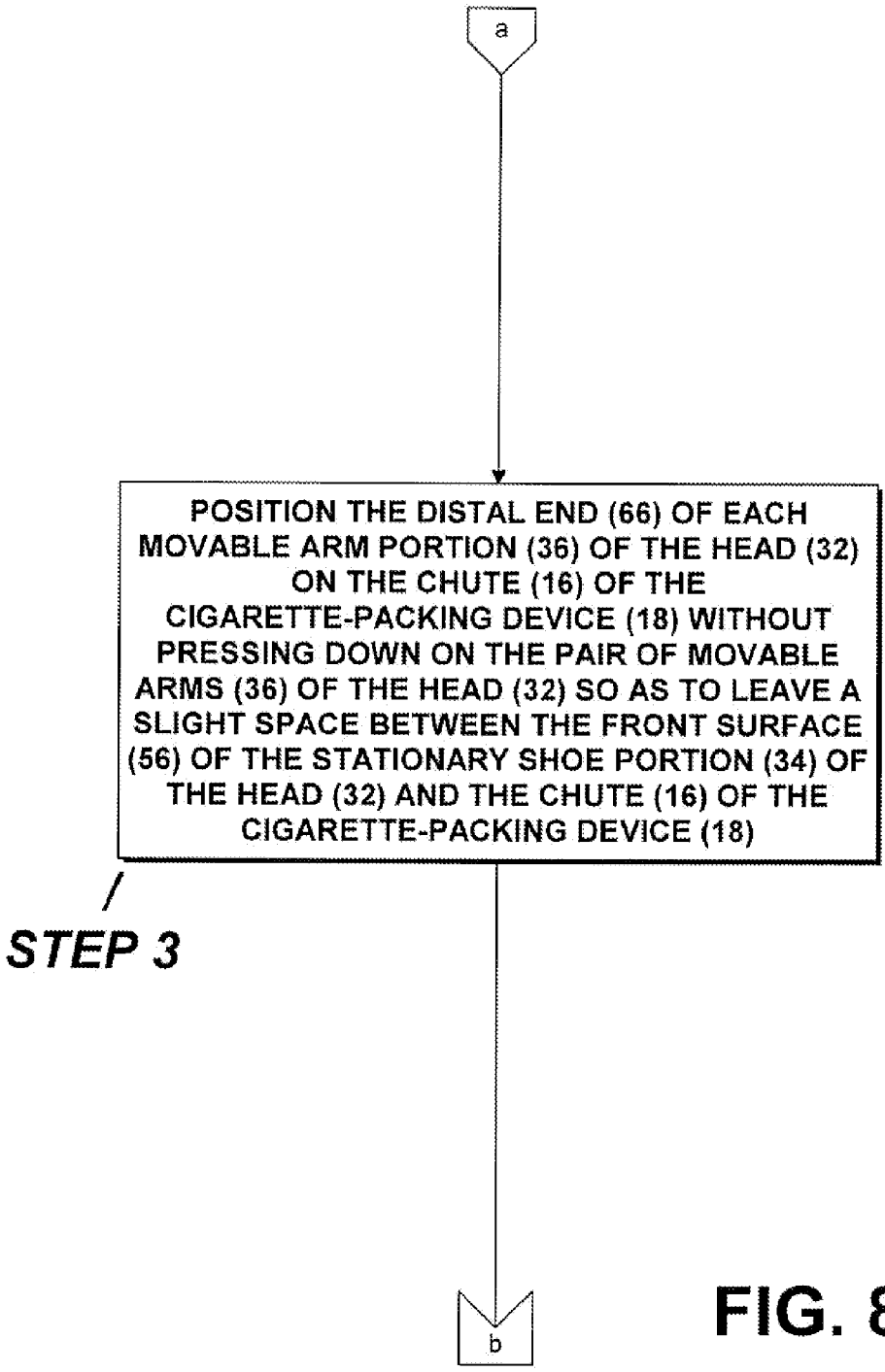
FIG. 8-B

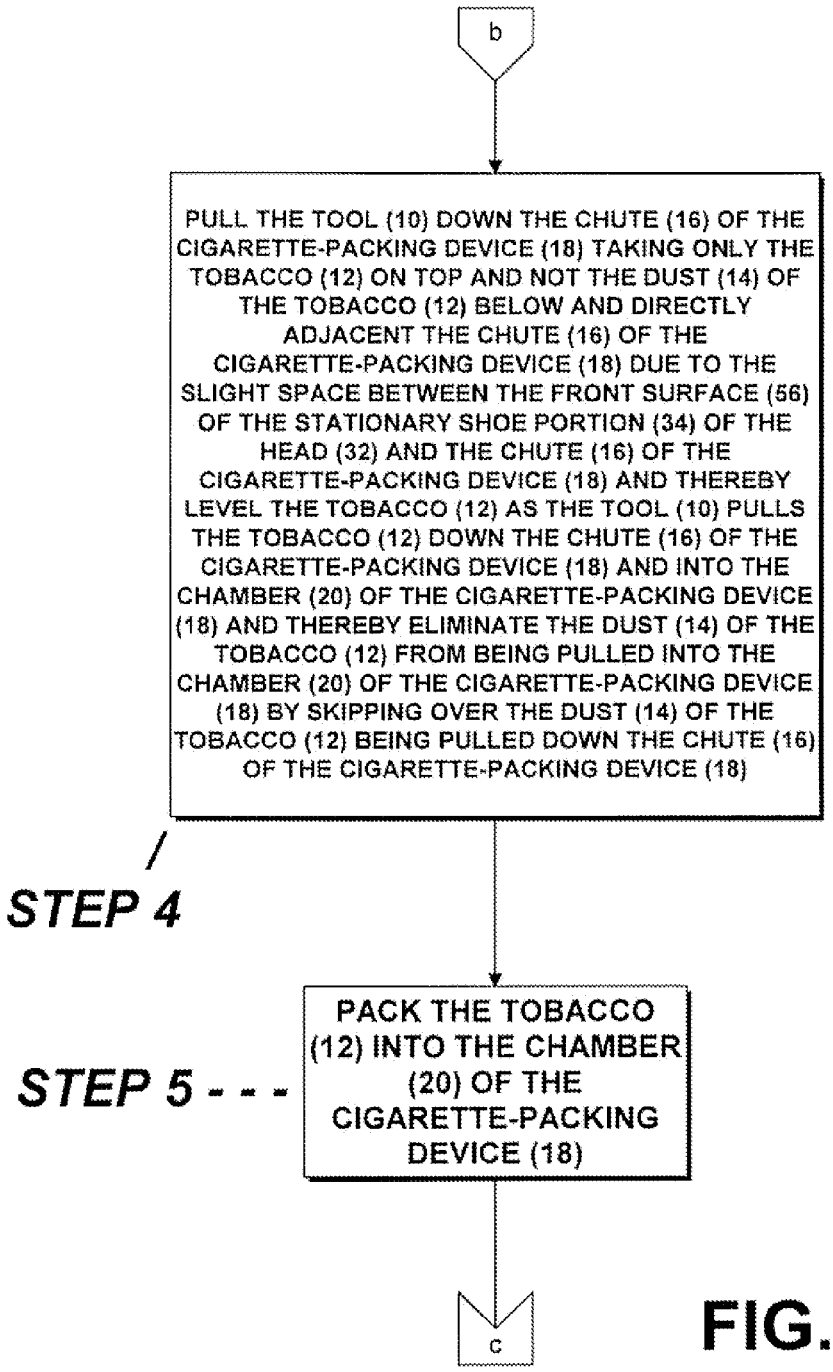
FIG. 8-C

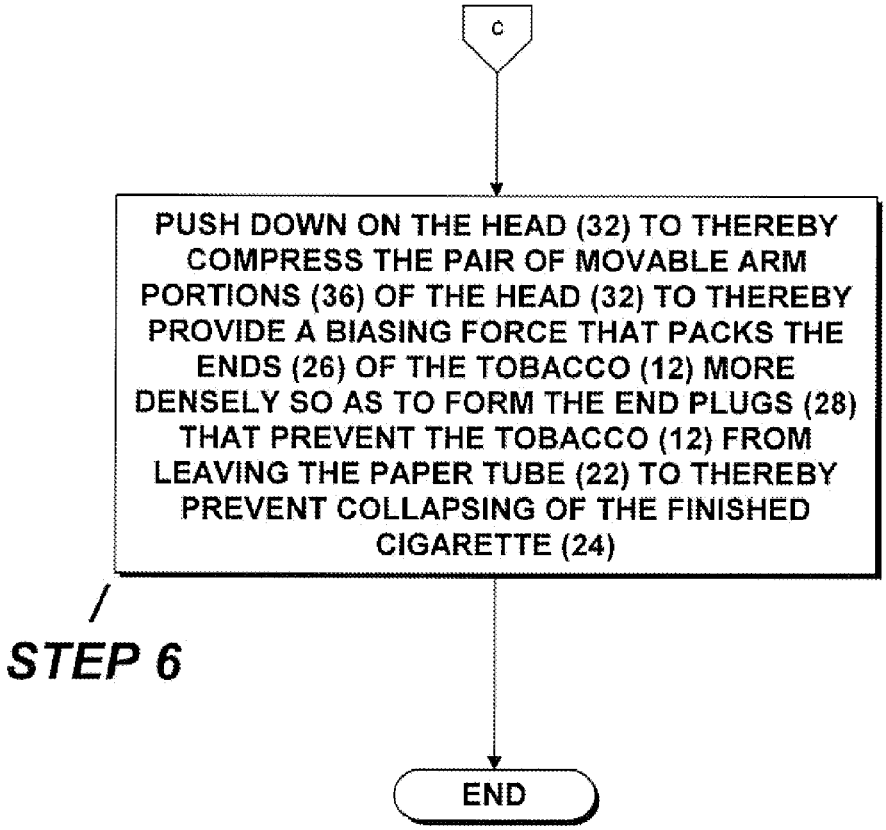
FIG. 8-D

TOBACCO CHAMBER TOOL

1. CROSS REFERENCES TO RELATED APPLICATIONS

The instant application contains subject matter disclosed in applicant's Provisional Patent Application, No. 61/685,655, filed on Mar. 21, 2012, with title Tobacco chamber tool and as such, it is respectfully requested that this Provisional Application be relied upon and remain a permanent part of the file history during the prosecution of the instant application and during any subsequent action thereof.

2. BACKGROUND OF THE INVENTION

A. Field of the Invention

The embodiments of the present invention relate to a tool, and more particularly, the embodiments of the present invention relate to a tool for leveling tobacco having dust as the tool pulls the tobacco down a chute of a cigarette-packing device and into a chamber of the cigarette-packing device utilized to fill a paper tube with the tobacco so as to form a finished cigarette, for eliminating the dust of the tobacco from being pulled into the chamber of the cigarette-packing device by skipping over the dust of the tobacco being pulled down the chute of the cigarette-packing device, and for packing ends of the tobacco in the chamber of the cigarette-packing device more densely so as to form end plugs that prevent the tobacco from leaving the paper tube to thereby prevent collapsing of a finished cigarette.

B. Description of the Prior Art

Currently, the only available device used to assist cigarette packing machines in packing tobacco into a tube of a cigarette is limited to a simple plastic wedge. The wedge lacks any density and specific distribution capabilities. The purpose of the wedge is to level the tobacco only after human fingers have placed the tobacco into the chamber of the cigarette packing machine by packing the ends first as instructed in the operating manuals of the cigarette-packing devices.

Failure to respect these instructions results in a faulty cigarette tube fill by exhibiting a paper tube collapse at the filter proximity area in addition to tobacco missing at the tip of the cigarette. The filter proximity area is precisely where a cigarette is held by a smoker. If this area receives an insufficient amount of tobacco during packing, the cigarette would be impossible to smoke. Paradoxically, being well aware of this dreaded mishap, the smoker takes extra care to fill the chamber of the cigarette-packing device with the tobacco, however, many times to avoid this mishap the tube is overfilled and the finished cigarette is rendered impossible to smoke. These common occurrences lead to frustration and waste of tubes and time, and eventually, giving up on a personal tobacco choice.

Additionally, many human fingers are generally too wide to fit into a tobacco chamber of the cigarette-packing device, thus causing the making of a personal cigarette uncomfortable and/or a hit-or-miss chore.

Numerous innovations for cigarette making devices have been provided in the prior art, which will be described below in chronological order to show advancement in the art, and which are incorporated in their entirety herein by reference thereto. Even though these innovations may be suitable for the specific individual purposes to which they address, nevertheless, they differ from the present invention in that they do not teach a tool for leveling tobacco having dust as the tool pulls the tobacco down a chute of a cigarette-packing device and into a chamber of the cigarette-packing device utilized to fill a paper tube with the tobacco so as to form a finished cigarette, for eliminating the dust of the tobacco from being pulled into the chamber of the cigarette-packing device by skipping over the dust of the tobacco being pulled down the chute of the cigarette-packing device, and for packing ends of the tobacco in the chamber of the cigarette-packing device more densely so as to form end plugs that prevent the tobacco from leaving the paper tube to thereby prevent collapsing of a finished cigarette.

(1) U.S. Pat. No. 705,591 to Ludington

U.S. Pat. No. 705,591—issued to Ludington on Jul. 29, 1902 in U.S. class 131 and subclass 72—teaches a machine for making individual cigarettes including a magazine having a stock of cit blanks supported therein, a pusher operated to move the stock of blanks forward, an arbor for winding the blanks, apparatus for seaming the edges of the blanks, and a crimping-mandrel and a crimping-toll for crimping the edges of the seamed blanks without passing the same.

(2) U.S. Pat. No. 1,967,610 to Edwards

U.S. Pat. No. 1,967,610—issued to Edwards on Jul. 24, 1934 in U.S. class 131 and subclass 94—teaches an apparatus for the manufacture of cigarettes by a method wherein a part of the tobacco filling is extracted from the mouthpiece end of a cigarette to provide a cavity for the reception of a filter tip. The apparatus includes a gripping unit adapted to grip tobacco in the end of a cigarette, and apparatus for effecting relative movement between the unit and the cigarette to cause the entry and withdrawal of the unit into and from the cigarette. The unit includes a number of members pointed for easy insertion into the tobacco filling of the cigarette. The unit is adapted upon withdrawal from the cigarette for engaging and extracting a part of the tobacco filling bodily in the form of a tuft avoiding disintegration or breaking up of the strands of the extracted tobacco. A reciprocating spoon device inserts a filter tip into the cavity formed in the cigarette. An intermittently movable carrier conveys the cigarettes into alignment with the gripping unit and the spoon. Apparatus discharges the cigarettes from the carrier.

(3) U.S. Pat. No. 2,022,461 to Edwards

U.S. Pat. No. 2,022,461—issued to Edwards on Nov. 26, 1935 in U.S. class 131 and subclass 88—teaches a device for use in forming a cavity in the mouthpiece end of a cigarette, which includes a rotary tubular tool having a sharpened edge adapted to exert a cutting action on the tobacco filling adjacent the wall of the cigarette paper tube or mouthpiece to facilitate effective withdrawal of part of the tobacco filling in the form of an unbroken slug.

(4) U.S. Pat. No. 2,997,828 to Ahlbor

U.S. Pat. No. 2,997,828—issued to Ahlbor on Aug. 29, 1961 in U.S. class 53 and subclass 505—teaches a cigarette packing machine including a supply container for the cigarettes, a feeding device for feeding cigarettes into the supply container, and apparatus for feeding cigarettes from the supply container to a package mechanism. The supply container includes at least one movable bounding member. A reversible driving apparatus is for the movable bounding member, first control apparatus is associated with the feeding device and is sensitive to the opposite condition of the feeding device. The reversible driving apparatus is connected to the first control apparatus and is operated thereby in dependance on the condition sensed to drive the bounding member in a first direction to decrease the capacity of the supply container when inactive condition of the feeding device is sensed by the first control apparatus. Second control means is associated with the packing mechanism and is sensitive to the operative condition of the packing mechanism. The reversible driving apparatus is connected to the second control apparatus and is operated thereby in dependence on the condition sensed to drive the bounding member in a second direction to increase the capacity of the supply container when inactive condition of the packing mechanism is sensed by the second control apparatus.

(5) U.S. Pat. No. 6,095,151 to Arthur

U.S. Pat. No. 6,095,151—issued to Arthur on Aug. 1, 2000 in U.S. class 131 and subclass 112—teaches a flat base anchored to any hard and smooth surface by two suction cups. Upon this flat base, two shafts rise perpendicular. The base supports a housing that fits over the base shafts. The housing has an opening that accommodates a standard pack of cigarettes that are placed in the opening top or filter first. Two springs are located above the housing on the base shafts to create tension. Rubber caps at the top of the base shafts, aided with epoxy, contains the springs and housing to the base so that once the housing is pulled upward by one's hand the housing then is forced down toward the base from the tension of the springs and consequently "packing" the cigarettes.

(6) U.S. Pat. No. 6,206,006 to Schutze et al

U.S. Pat. No. 6,206,006—issued to Schutze et al. on Mar. 27, 2001 in U.S. class 131 and subclass 70—teaches a hand filling device for cigarette tubes, particularly, for filter cigarette tubes, with a tobacco press chamber extending in the longitudinal direction thereof, which is formed by a casing located in the base portion, a press head is provided on a lid covering the casing and is hinged to the casing, an ejector slide ejects a tobacco skein pressed in a tobacco chamber via an opening provided in the casing into a (filter) cigarette tube of a clamp device that holds the (filter) cigarette tube in a clamping manner on a socket located at the outlet of the tobacco press chamber, and a resiliently-engaging, snap-in or the like device detachable connects the casing and the lid. In order to adapt the filling length of the tobacco chamber, there is associated with the ejector slide an off-settable stop apparatus by way of which the tobacco filling position of the ejector slide is alterable adapting to the desired filling length of the tobacco press chamber.

(7) U.S. Pat. No. 7,677,251 to Barnes et al

U.S. Pat. No. 7,677,251—issued to Barnes et al. on Mar. 16, 2010 in U.S. class 131 and subclass 65—teaches an apparatus and method for manufacturing small quantities of cigarettes that provides for such manufacture in a substantially simultaneous fashion while maintaining consistent quality between the cigarettes. The apparatus and method provide for delivering at least one charge of tobacco filler from a supply of tobacco filler onto a predetermined length of wrapping paper in a garniture. The wrapping paper is formed about the charge of tobacco filler by a forming mechanism in the garniture to form a cigarette rod having a finite length. The formed cigarette rod is then transferred to a cutting device where in a separate step the cigarette rod is cut into a plurality of individual cigarettes. The cigarettes may have filter elements attached, and may be packaged for a consumer. The filter element and tipping paper provide for air dilution of the cigarettes.

It is apparent that numerous innovations for cigarette making devices have been provided in the prior art, which are adapted to be used. Furthermore, even though these innovations may be suitable for the specific individual purposes to which they address, nevertheless, they would not be suitable for the purposes of the embodiments of the present invention as heretofore described, namely, a tool for leveling tobacco having dust as the tool pulls the tobacco down a chute of a cigarette-packing device and into a chamber of the cigarette-packing device utilized to fill a paper tube with the tobacco so as to form a finished cigarette, for eliminating the dust of the tobacco from being pulled into the chamber of the cigarette-packing device by skipping over the dust of the tobacco being pulled down the chute of the cigarette-packing device, and for packing ends of the tobacco in the chamber of the cigarette-packing device more densely so as to form end plugs that prevent the tobacco from leaving the paper tube to thereby prevent collapsing of a finished cigarette.

3. SUMMARY OF THE INVENTION

Thus, an object of the embodiments of the present invention is to provide a tool for leveling tobacco having dust as the tool pulls the tobacco down a chute of a cigarette-packing device and into a chamber of the cigarette-packing device utilized to fill a paper tube with the tobacco so as to form a finished cigarette, for eliminating the dust of the tobacco from being pulled into the chamber of the cigarette-packing device by skipping over the dust of the tobacco being pulled down the chute of the cigarette-packing device, and for packing ends of the tobacco in the chamber of the cigarette-packing device more densely so as to form end plugs that prevent the tobacco from leaving the paper tube to thereby prevent collapsing of a finished cigarette, which avoids the disadvantages of the prior art.

Briefly stated, another object of the embodiments of the present invention is to provide a tool that levels tobacco having dust as the tool pulls the tobacco down a chute of a cigarette-packing device and into a chamber of the cigarette-packing device utilized to fill a paper tube with the tobacco so as to form a finished cigarette, eliminates the dust of the tobacco from being pulled into the chamber of the cigarette-packing device by skipping over the dust of the tobacco being pulled down the chute of the cigarette-packing device, and packs ends of the tobacco in the chamber of the cigarette-packing device more densely so as to form end plugs that prevent the tobacco from leaving the paper tube to thereby prevent collapsing of the finished cigarette. The tool includes a handle and a head. The head has a fixed shoe portion and a pair of movable arm portions. The head extends from the handle. The fixed shoe portion of the head levels the tobacco as the tool pulls the tobacco down the chute of the cigarette-packing device and into the chamber of the cigarette-packing device utilized to fill the paper tube with the tobacco so as to form the finished cigarette. The pair of movable arm portions of the head extend from the fixed shoe portion of the head, eliminate the dust of the tobacco from being pulled into the chamber of the cigarette-packing device by skipping over the dust of the tobacco being pulled down the chute of the cigarette-packing device, and pack the ends of the tobacco in the chamber of the cigarette-packing device more densely so as to from the end plugs that prevent the tobacco from leaving the paper tube to thereby prevent collapsing of the finished cigarette.

The novel features considered characteristic of the embodiments of the present invention are set forth in the appended claims. The embodiments of the present invention themselves, however, both as to their constriction and to their method of operation together with additional objects and advantages thereof will be best understood from the following description of the specific embodiments when read and understood in connection with the accompanying figures of the drawing.

4. BRIEF DESCRIPTION OF THE FIGURES OF THE DRAWING

The figures of the drawing are briefly described as follows:

FIG. 1 is a diagrammatic perspective view of the tool of the embodiments of the present invention leveling tobacco having dust as the tool pulls the tobacco down a chute of a cigarette-packing device and into a chamber of the cigarette-packing device utilized to fill a paper tube with the tobacco so as to form a finished cigarette, eliminating the dust of the tobacco from being pulled into the chamber of the cigarette-packing device by skipping over the dust of the tobacco being pulled down the chute of the cigarette-packing device, and packing ends of the tobacco in the chamber of the cigarette-packing device more densely so as to form end plugs that prevent the tobacco from leaving the paper tube to thereby prevent collapsing of the finished cigarette;

Figure 1:
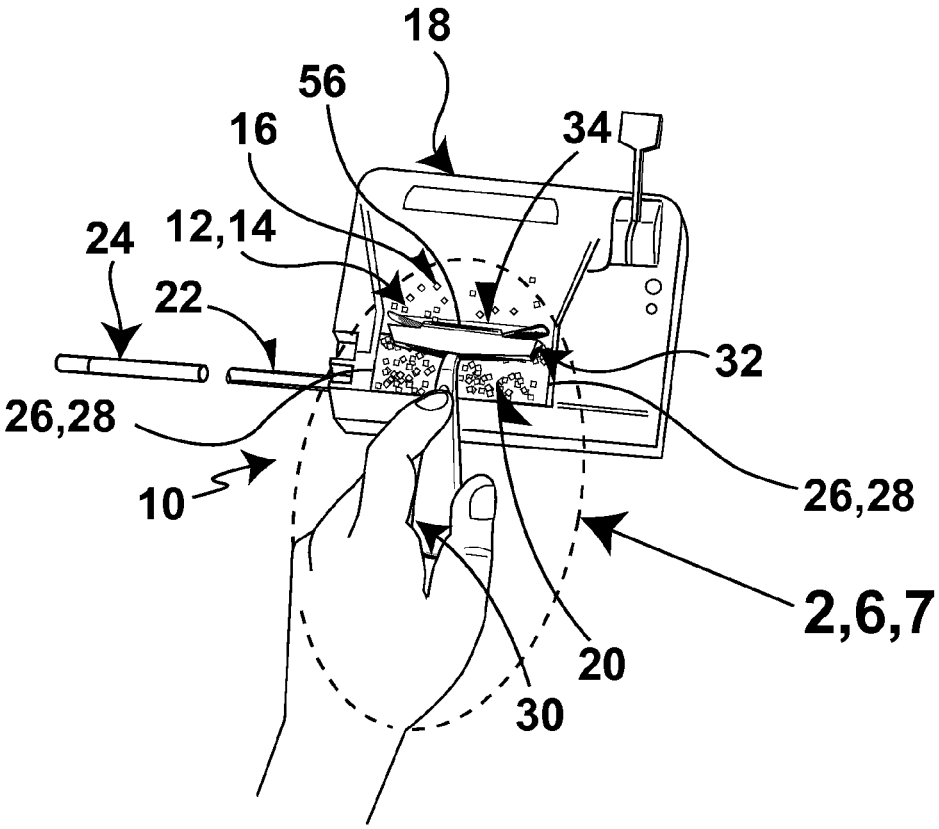
Figure 6:
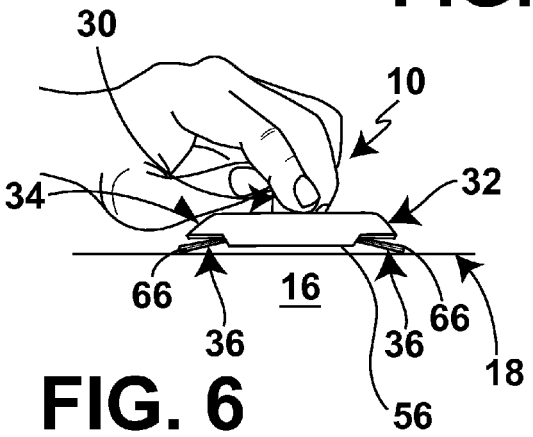
Figure 7:
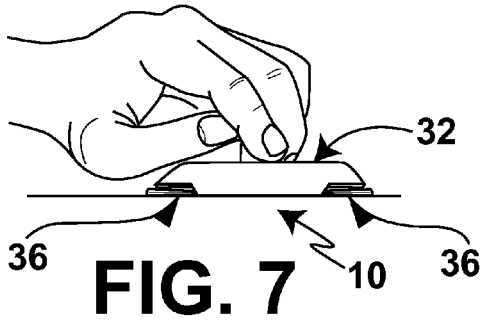

FIG. 6 is an enlarged diagrammatic perspective view of the area generally enclosed by the dotted curve identified by ARROW 6 in FIG. 1 of the tool of the embodiments of the present invention ready to level the tobacco and ready to eliminate the dust of the tobacco from being pulled into the chamber of the cigarette-packing device by skipping over the dust of the tobacco being pulled down the chute of the cigarette-packing device;

FIG. 7 is an enlarged diagrammatic perspective view of the area generally enclosed by the dotted curve identified by ARROW 7 in FIG. 1 of the tool of the embodiments of the present invention packing the ends of the tobacco in the chamber of the cigarette-packing device more densely so as to form end plugs that prevent the tobacco from leaving the paper tube to thereby prevent collapsing of the finished cigarette; and FIGS. 8A-8D are a diagrammatic flowchart of the method for operating the tool of the embodiments of the present invention.

5. LIST OF REFERENCE NUMERALS UTILIZED IN THE FIGURES OF THE DRAWING

A. Introductory.

10 tool of embodiments of present invention for leveling tobacco 12 having dust 14 as tool 10 pulls tobacco 12 down chute 16 of cigarette-packing device 18 and into chamber 20 of cigarette-packing device 18 utilized to fill paper tube 22 with tobacco 12 so as to form finished cigarette 24, for eliminating dust 14 of tobacco 12 from being pulled into chamber 20 of cigarette-packing device 18 by skipping over dust 14 of tobacco 12 being pulled in chute 16 of cigarette-packing device 18, and for packing ends 26 of tobacco 12 in chamber 20 of cigarette-packing device 18 more densely so as to form end plugs 28 that prevent tobacco 12 from leaving paper tube 22 to thereby prevent collapsing of finished cigarette 24

12 tobacco

14 dust of tobacco 12

16 chute of cigarette-packing device 18

18 cigarette-packing device

20 chamber of cigarette-packing device 18

22 paper tube

24 finished cigarette

26 ends of tobacco 12

28 end plugs of ends 26 of tobacco 12

B. Overall Configuration of Tool 10.

30 handle

32 head

34 stationary shoe portion of head 32 for leveling tobacco 12 as tool 10 pulls tobacco 12 down chute 16 of cigarette-packing device 18 and into chamber 20 of cigarette-packing device 18

36 pair of movable arm portions of head 32 for eliminating dust 14 of tobacco 12 from being pulled into chamber 20 of cigarette-packing device 18 by skipping over dust 14 of tobacco 12 being pulled in chute 16 of cigarette-packing device 18, and for packing ends 26 of tobacco 12 in chamber 20 of cigarette-packing device 18 more densely so as to form end plugs 28 that prevent tobacco 12 from leaving paper tube 22 to thereby prevent collapsing of finished cigarette 24

C. Specific Configuration of Handle 30.

38 proximal end of handle 30

40 distal end of handle 30

42 rear surface of handle 30

44 front surface of handle 30

46 body portion of handle 30

47 transition point of handle 30

48 neck portion of handle 30

50 magnet of handle 30 for replaceably attaching tool 10 to magnetically attracting surface 52

52 magnetically attracting surface

D. Specific Configuration of Head 32.

54 center point of head 32

E. Specific Configuration of Stationary Shoe Portion 34 of Head 32.

56 front surface of stationary shoe portion 34 of head 32

58 pair of ends of stationary shoe portion 34 of head 32

60 pair of recesses of front surface 56 of stationary shoe portion 34 of head 32

62 inner terminators of pair of recesses 60 of front surface 56 of stationary shoe portion 34 of head 32, respectively F. Specific Configuration of Pair of Movable Arm Portions 36 of Head 32.

64 proximal end of each movable arm portion of pair of movable arm portions 36 of head 32

66 distal end of each movable arm portion of pair of movable arm portions 36 of head 32

6. DETAILED DESCRIPTION OF THE PREFERRED EMBODIMENTS

A. Introductory.

Referring now to the figures, in which like numerals indicate like parts, and particularly to FIG. 1, which is a diagrammatic perspective view of the tool of the embodiments of the present invention leveling tobacco having dust as the tool pulls the tobacco down a chute of a cigarette-packing device and into a chamber of the cigarette-packing device utilized to fill a paper tube with the tobacco so as to form a finished cigarette, eliminating the dust of the tobacco from being pulled into the chamber of the cigarette-packing device by skipping over the dust of the tobacco being pulled down the chute of the cigarette-packing device, and packing ends of the tobacco in the chamber of the cigarette-packing device more densely so as to form end plugs that prevent the tobacco from leaving the paper tube to thereby prevent collapsing of the finished cigarette, the tool of the embodiments of the present invention is shown generally at 10 for leveling tobacco 12 having dust 14 as the tool 10 pulls the tobacco 12 down a chute 16 of a cigarette-packing device 18 and into a chamber 20 of the cigarette-packing device 18 utilized to fill a paper tube 22 with the tobacco 12 so as to form a finished cigarette 24, for eliminating the dust 14 of the tobacco 12 from being pulled into the chamber 20 of the cigarette-packing device 18 by skipping over the dust 14 of the tobacco 12 being pulled down the chute 16 of the cigarette-packing device 18, and for packing ends 26 of the tobacco 12 in the chamber 20 of the cigarette-packing device 18 more densely so as to form end plugs 28 that prevent the tobacco 12 from leaving the paper tube 22 to thereby prevent collapsing of the finished cigarette 24.

B. Overall Configuration of the Tool 10.

Figure 2:
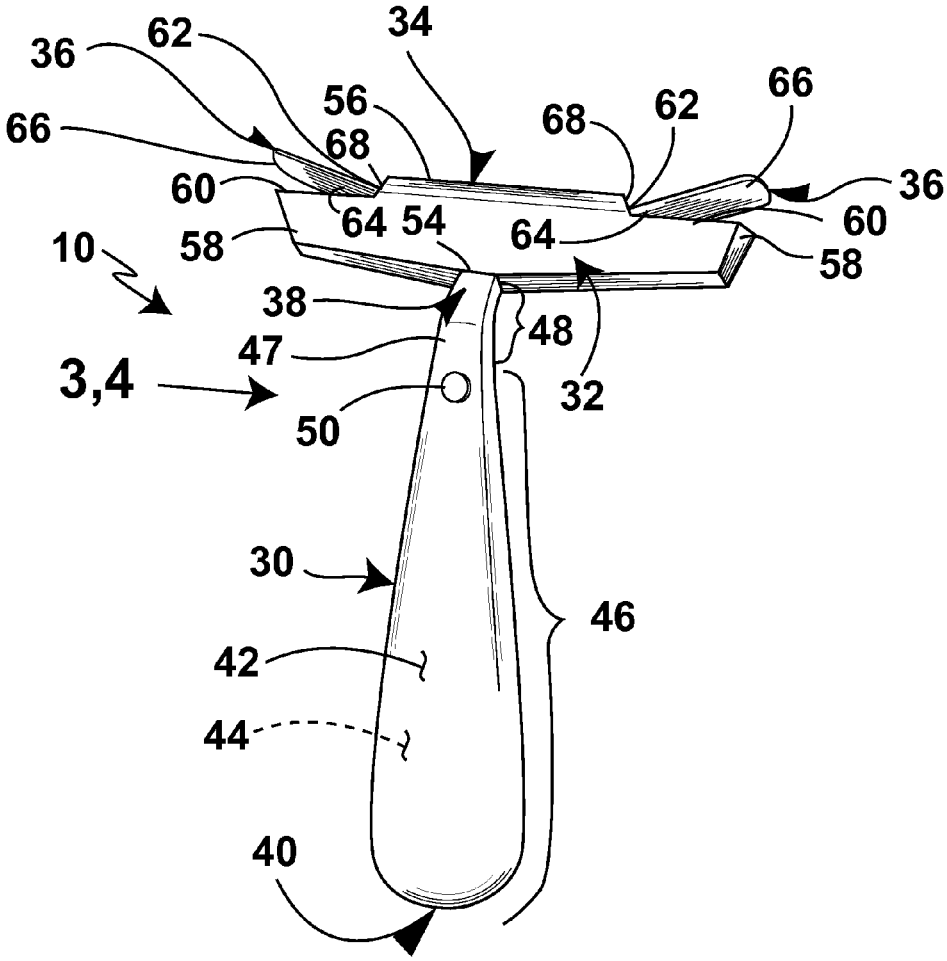
FIG. 2 is an enlarged diagrammatic perspective view of the area generally enclosed by the dotted curve identified by ARROW 2 in FIG. 1 of the tool of the embodiments of the present invention.
Figure 3:
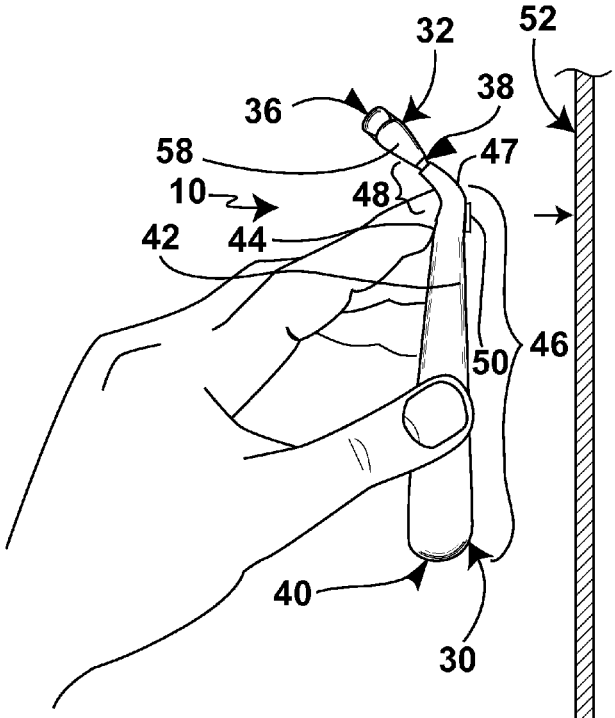
FIG. 3 is a reduced diagrammatic side elevational view taken generally in the direction of ARROW 3 in FIG. 2 of the tool of the embodiments of the present invention attaching to a magnetically attracting surface.
Figure 4:
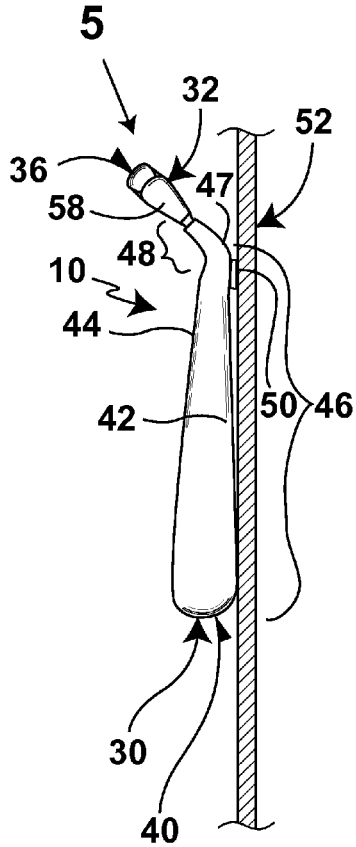
FIG. 4 is a reduced diagrammatic side elevational view taken generally in the direction of ARROW 4 in FIG. 2 of the tool of the embodiments of the present invention attached to a magnetically attracting surface.
Figure 5:
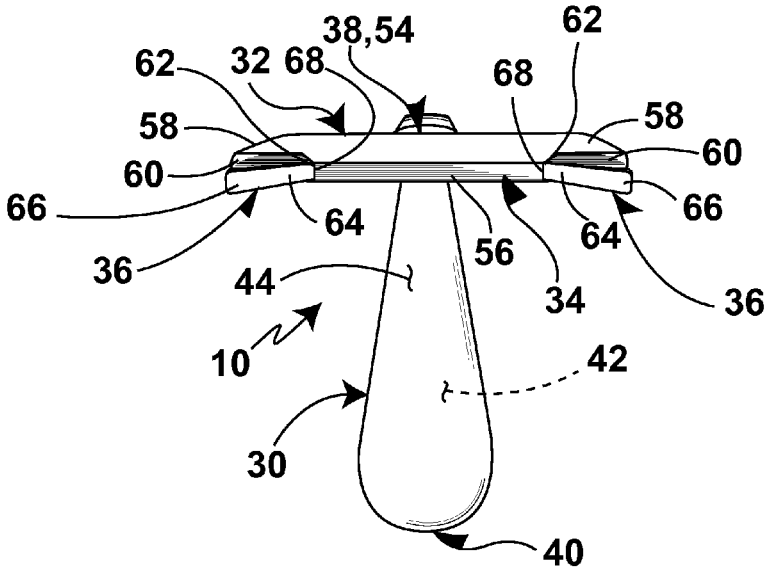
FIG. 5 is an enlarged diagrammatic perspective view taken generally in the direction of ARROW 5 in FIG. 4 of the tool of the embodiments of the present invention.

The overall configuration of the tool 10 can best be seen in FIGS. 2-5, which are, respectively, an enlarged diagrammatic perspective view of the area generally enclosed by the dotted curve identified by ARROW 2 in FIG. 1 of the tool of the embodiments of the present invention, a reduced diagrammatic side elevational view taken generally in the direction of ARROW 3 in FIG. 2 of the tool of the embodiments of the present invention attaching to a magnetically attracting surface, a reduced diagrammatic side elevational view taken generally in the direction of ARROW 4 in FIG. 2 of the tool of the embodiments of the present invention attached to a magnetically attracting surface, and an enlarged diagrammatic perspective view taken generally in the direction of ARROW 5 in FIG. 4 of the tool of the embodiments of the present invention, and as such, will be discussed with reference thereto.

The tool 10 includes a handle 30 and a head 32.

The head 32 has a stationary shoe portion 34 and a pair of movable arm portions 36.

The head 32 extends from the handle 30.

The stationary shoe portion 34 of the head 32 is for leveling the tobacco 12 as the tool 10 pulls the tobacco 12 down the chute 16 of the cigarette-packing device 18 and into the chamber 20 of the cigarette-packing device 18.

The pair of movable arm portions 36 of the head 32 extend from the stationary shoe portion 34 of the head 32, are for eliminating the dust 14 of the tobacco 12 from being pulled into the chamber 20 of the cigarette-packing device 18 by skipping over the dust 14 of the tobacco 12 being pulled down the chute 16 of the cigarette-packing device 18, and are for packing the ends 26 of the tobacco 12 in the chamber 20 of the cigarette-packing device 18 more densely so as to from the end plugs 28 that prevent the tobacco 12 from leaving the paper tube 22 to thereby prevent collapsing of the finished cigarette 24.

C. Specific Configuration of the Handle 30.

The handle 30 is slender, elongated, and ergonomically shaped.

The handle 30 has a proximal end 38, a distal end 40, a rear surface 42, and a front surface 44.

The handle 30 extends generally straight from the distal end 40 of the handle 30 to short of the proximal end 38 of the handle 30 as a body portion 46 of the handle 30, and then bends smoothly therefrom in an obtuse angle at a transition point 47 of the handle 30 towards the front surface 44 of the handle 30 to terminate in the proximal end 38 of the handle 30 as a neck portion 48 of the handle 30, to thereby allow the body portion 46 of the handle to extend from the distal end 40 of the handle 30 to the transition 47 of the handle 30, and to thereby allow the neck portion 48 of the handle 30 to extend from the transition point 47 of the handle 30 to the proximal end 38 of the handle 30.

The distal end 40 of the handle 30 is generally hemispherically shaped for safety as a part of being ergonomically shaped.

The handle 30 tapers from the distal end 40 of the handle 30 to the proximal end 38 of the handle 30 in orthogonal planes as another part of being ergonomically shaped.

The handle 30 further has a magnet 50. The magnet 50 of the handle 30 is for replaceably attaching the tool 10 to a magnetically attracting surface 52.

The magnet 50 of the handle 30 is thin, disc-shaped, disposed on the rear surface 42 of the handle 30, and is positioned just below the transition point 47 of the handle 30.

D. Specific Configuration of the Head 32.

The head 32 has a center point 54. The head 32 extends perpendicularly across the proximal end 38 of the handle 30, and is attached thereto at the center point 54 of the head 32 so as to allow the head 32 to extend equidistantly from both sides of the handle 30.

The head 32 is generally coplanar with the neck portion 48 of the handle 30 so as to make an obtuse angle with the body portion 40 of the handle 30.

E. Specific Configuration of the Stationary Shoe Portion 34 of the Head 32.

The stationary shoe portion 34 of the head 32 extends perpendicularly across the proximal end 38 of the handle 30, and is attached thereto at the center point 54 of the head 32 so as to allow the stationary shoe portion 34 of the head 32 to extend equidistantly from both sides of the handle 30.

The stationary shoe portion 34 of the head 32 is generally coplanar with the neck portion 48 of the handle 30 so as to make an obtuse angle with the body portion 40 of the handle 30.

The stationary shoe portion 34 of the head 32 is slender, elongated, and has a front surface 56 and a pair of ends 58.

The front surface 56 of the stationary shoe portion 34 of the head 32 has a pair of recesses 60.

The pair of recesses 60 of the front surface 56 of the stationary shoe portion 34 of the head 32 are mirror images of each other, and extend inwardly to inner terminators 62.

The pair of recesses 60 of the front surface 56 of the stationary shoe portion 34 of the head 32 communicate with the pair of ends 58 of the stationary shoe portion 34 of the head 32, respectively.

The inner terminators 62 of the pair of recesses 60 of the front surface 56 of the stationary shoe portion 34 of the head 32, respectively, are equidistant from the pair of ends 58 of the stationary shoe portion 34 of the head 32, respectively.

F. Specific Configuration of the Pair of Movable Arm Portions 36 of the Head 32.

Each movable arm portion 36 of the head 32 is slender, elongated, and has a proximal end 64, a distal end 66, and a length.

The proximal end 64 of each movable arm portion 36 of the head 32 is pivotally connected to the inner terminator 62 of an associated recess 60 of the front surface 56 of the stationary shoe portion 34 of the head 32 by a living hinge 68.

Each movable arm portion 36 of the head 32 moves in the associated recess 60 of the front surface 56 of the stationary shoe portion 34 of the head 32.

Each movable arm portion 36 of the head 32 extends normally skewly outwardly and upwardly from the inner terminator 62 of the associated recess 60 of the front surface 56 of the stationary shoe portion 34 of the head 32, and is biased thereto.

The length of each movable arm portion 36 of the head 32 is greater than that of the associated recess 60 of the front surface 56 of the stationary shoe portion 34 of the head 32.

G. Method for Operating the Tool 10.

The method for operating the tool 10 can best be seen in FIGS. 1, 6, 7, and 8A-8D, which are, respectively, again, a diagrammatic perspective view of the tool of the embodiments of the present invention leveling tobacco having dust as the tool pulls the tobacco down a chute of a cigarette-packing device and into a chamber of the cigarette-packing device utilized to fill a paper tube with the tobacco so as to form a finished cigarette, eliminating the dust of the tobacco from being pulled into the chamber of the cigarette-packing device by skipping over the dust of the tobacco being pulled down the chute of the cigarette-packing device, and packing ends of the tobacco in the chamber of the cigarette-packing device more densely so as to form end plugs that prevent the tobacco from leaving the paper tube to thereby prevent collapsing of the finished cigarette, an enlarged diagrammatic perspective view of the area generally enclosed by the dotted curve identified by ARROW 6 in FIG. 1 of the tool of the embodiments of the present invention ready to level the tobacco and ready to eliminate the dust of the tobacco from being pulled into the chamber of the cigarette-packing device by skipping over the dust of the tobacco being pulled down the chute of the cigarette-packing device, an enlarged diagrammatic perspective view of the area generally enclosed by the dotted curve identified by ARROW 7 in FIG. 1 of the tool of the embodiments of the present invention packing the ends of the tobacco in the chamber of the cigarette-packing device more densely so as to form end plugs that prevent the tobacco from leaving the paper tube to thereby prevent collapsing of the finished cigarette, and a diagrammatic flowchart of the method for operating the tool of the embodiments of the present invention, and as such, will be discussed with reference thereto.

STEP 1: As shown in FIGS. 1 and 8A, load the tobacco 12 into the chute 16 of the cigarette-packing device 18;

STEP 2: As shown in FIGS. 1, 6, and 8A, grasp the handle 30 of the tool 10;

STEP 3: As shown in FIGS. 6 and 8B, position the distal end 66 of each movable arm portion 36 of the head 32 on the chute 16 of the cigarette-packing device 18 without pressing down on the pair of movable arms 36 of the head 32 so as to leave a slight space between the front surface 56 of the stationary shoe portion 34 of the head 32 and the chute 16 of the cigarette-packing device 18;

STEP 4: As shown in FIGS. 1 and 8C, pull the tool 10 down the chute 16 of the cigarette-packing device 18 taking only the tobacco 12 on top and not the dust 14 of the tobacco 12 below and directly adjacent the chute 16 of the cigarette-packing device 18 due to the slight space between the front surface 56 of the stationary shoe portion 34 of the head 32 and the chute 16 of the cigarette-packing device 18 and thereby level the tobacco 12 as the tool 10 pulls the tobacco 12 down the chute 16 of the cigarette-packing device 18 and into the chamber 20 of the cigarette-packing device 18 and thereby eliminate the dust 14 of the tobacco 12 from being pulled into the chamber 20 of the cigarette-packing device 18 by skipping over the dust 14 of the tobacco 12 being pulled down the chute 16 of the cigarette-packing device 18;

STEP 5: As shown in FIGS. 1 and 8C, pack the tobacco 12 into the chamber 20 of the cigarette-packing device 18; and STEP 6: As shown in FIGS. 7 and 8D, push down on the head 32 to thereby compress the pair of movable arm portions 36 of the head 32 to thereby provide a biasing force that packs the ends 26 of the tobacco 12 more densely so as to form the end plugs 28 that prevent the tobacco 12 from leaving the paper tube 22 to thereby prevent collapsing of the finished cigarette 24.

H. Impressions.

It will be understood that each of the elements described above or two or more together may also find a useful application in other types of constructions differing from the types described above.

While the embodiments of the present invention have been illustrated and described as embodied in a tool for leveling tobacco having dust as the tool pulls the tobacco down a chute of a cigarette-packing device and into a chamber of the cigarette-packing device utilized to fill a paper tube with the tobacco so as to form a finished cigarette, for eliminating the dust of the tobacco from being pulled into the chamber of the cigarette-packing device by skipping over the dust of the tobacco being pulled down the chute of the cigarette-packing device, and for packing ends of the tobacco in the chamber of the cigarette-packing device more densely so as to form end plugs that prevent the tobacco from leaving the paper tube to thereby prevent collapsing of a finished cigarette, however, they are not limited to the details shown, since it will be understood that various omissions, modifications, substitutions, and changes in the forms and details of the embodiments of the present invention illustrated and their operation can be made by those skilled in the art without departing in any way from the spirit of the embodiments of the present invention.

Without further analysis, the foregoing will so fully reveal the gist of the embodiments of the present invention that others can by applying current knowledge readily adapt them for various applications without omitting features that from the standpoint of prior art fairly constitute characteristics of the generic or specific aspects of the embodiments of the present invention.

The invention claimed is:

1. A tool for leveling tobacco having dust as said tool pulls tobacco down a chute of a cigarette-packing device and into a chamber of the cigarette-packing device utilized to fill a paper tube with the tobacco so as to form a finished cigarette, for eliminating the dust of the tobacco from being pulled into the chamber of the cigarette-packing device by skipping over the dust of the tobacco being pulled down the chute of the cigarette-packing device, and for packing ends of the tobacco in the chamber of the cigarette-packing device more densely so as to form end plugs that prevent the tobacco from leaving the paper tube to thereby prevent collapsing of the finished cigarette, comprising:

a) a handle; and b) a head;

wherein said head has:

a) a stationary shoe portion; and b) a pair of movable arm portions;

wherein said head extends from said handle;

wherein said stationary shoe portion of said head is for leveling the tobacco as said tool pulls the tobacco down the chute of the cigarette-packing device and into the chamber of the cigarette-packing device;

wherein said pair of movable arm portions of said head extend from said stationary shoe portion of said head;

wherein said pair of movable arm portions of said head are for eliminating the dust of the tobacco from being pulled into the chamber of the cigarette-packing device by skipping over the dust of the tobacco being pulled down the chute of the cigarette-packing device; and wherein said pair of movable arm portions of said head are for packing the ends of the tobacco in the chamber of the cigarette-packing device more densely so as to from the end plugs that prevent the tobacco from leaving the paper tube to thereby prevent collapsing of the finished cigarette;

wherein said stationary shoe portion of said head has a front surface; and wherein said front surface stationary shoe portion of said head has a pair of recesses;

wherein said stationary shoe portion of said head has a pair of ends;

wherein said pair of recesses of said front surface of said stationary shoe portion of said head extend inwardly to inner terminators from said pair of ends of said stationary shoe portion of said head, respectively;

wherein each movable arm portion of said head has a proximal end; and wherein said proximal end of each movable arm portion of said head is pivotally connected to said inner terminator of an associated recess of said front surface of said stationary shoe portion of said head by a living hinge.

2. The tool of claim 1, wherein said handle is slender.

3. The tool of claim 1, wherein said handle is elongated.

4. The tool of claim 1, wherein said handle is ergonomically shaped.

5. The tool of claim 1, wherein said handle has a proximal end;

wherein said handle has a distal end;

wherein said handle has a front surface; and wherein said handle extends generally straight from said distal end of said handle to short of said proximal end of said handle as a body portion of said handle, and then bends smoothly therefrom in an obtuse angle at a transition point of said handle towards said front surface of said handle to terminate in said proximal end of said handle as a neck portion of said handle, to thereby allow said body portion of said handle to extend from said distal end of said handle to said transition of said handle, and to thereby allow said neck portion of said handle to extend from said transition point of said handle to said proximal end of said handle.

6. The tool of claim 5, wherein said distal end of said handle is generally hemispherically shaped for safety as a part of being ergonomically shaped.

7. The tool of claim 5, wherein said handle tapers from said distal end of said handle to said proximal end of said handle in orthogonal planes as a part of being ergonomically shaped.

8. The tool of claim 5, wherein said handle has a magnet; and wherein said magnet of said handle is for replaceably attaching said tool to a magnetically attracting surface.

9. The tool of claim 8, wherein said magnet of said handle is thin.

10. The tool of claim 8, wherein said magnet of said handle is disc-shaped.

11. The tool of claim 8, wherein said handle has a rear surface; and wherein said magnet of said handle is disposed on said rear surface of said handle.

12. The tool of claim 8, wherein said magnet of said handle is positioned just below said transition point of said handle.

13. The tool of claim 5, wherein said head has a center point; and wherein said head extends perpendicularly across said proximal end of said handle and is attached thereto at said center point of said head so as to allow said head to extend equidistantly from both sides of said handle.

14. The tool of claim 5, wherein said head is generally coplanar with said neck portion of said handle so as to make an obtuse angle with said body portion of said handle.

15. The tool of claim 13, wherein said stationary shoe portion of said head extends perpendicularly across said proximal end of said handle, and is attached thereto, at said center point of said head so as to allow said stationary shoe portion of said head to extend equidistantly from both sides of said handle.

16. The tool of claim 5, wherein said stationary shoe portion of said head is generally coplanar with said neck portion of said handle so as to make an obtuse angle with said body portion of said handle.

17. The tool of claim 1, wherein said stationary shoe portion of said head is slender.

18. The tool of claim 1, wherein said stationary shoe portion of said head is elongated.

19. The tool of claim 1, wherein said pair of recesses of said front surface of said stationary shoe portion of said head are mirror images of each other.

20. The tool of claim 1, wherein said pair of recesses of said front surface of said stationary shoe portion of said head extend equidistantly from said pair of ends of said stationary shoe portion of said head, respectively.

21. The tool of claim 1, wherein said pair of recesses of said front surface of said stationary shoe portion of said head communicate with said pair of ends of said stationary shoe portion of said head, respectively.

22. The tool of claim 1, wherein each movable arm portion of said head is slender; and wherein each movable arm portion of said head is elongated.

23. The tool of claim 1, wherein each movable arm portion of said head moves in an associated recess of said front surface of said stationary shoe portion of said head.

24. The tool of claim 1, wherein each movable arm portion of said head extends normally skewly outwardly and upwardly from said inner terminator of an associated recess of said front surface of said stationary shoe portion of said head.

25. The tool of claim 1, wherein each movable arm portion of said head is normally biased from said inner terminator of an associated recess of said front surface of said stationary shoe portion of said head.

26. The tool of claim 1, wherein each movable arm portion of said head has a length;

wherein each recess of the front surface of the stationary shoe portion of the head has a length; and wherein said length of each movable arm portion of said head is greater than said length of an associated recess of said front surface of said stationary shoe portion of said head.

* * * * *